United States Patent [19]

Zoladz

[11] Patent Number: 4,836,399

[45] Date of Patent: Jun. 6, 1989

[54] IMPROVED LIQUID TIGHT TRANSFORMER CASING

[75] Inventor: Frank J. Zoladz, Morristown, Tenn.

[73] Assignee: North American Philips Consumer Electronics Co., New York, N.Y.

[21] Appl. No.: 259,470

[22] Filed: Oct. 17, 1988

Related U.S. Application Data

[63] Continuation of Ser. No. 97,485, Sep. 15, 1987, abandoned, which is a continuation of Ser. No. 842,055, Mar. 18, 1986, Pat. No. 4,709,828, which is a continuation of Ser. No. 746,488, Jun. 19, 1985, abandoned.

[51] Int. Cl.[4] ..... B65D 6/34

[52] U.S. Cl. ..... 220/76; 220/352

[58] Field of Search ..... 220/75, 76, 81 R, 358, 220/356, 354, 352

[56] References Cited

U.S. PATENT DOCUMENTS

| | | | |
|---|---|---|---|
| 1,348,550 | 8/1920 | Dister | 220/354 |
| 1,543,533 | 6/1925 | Treanor . | |
| 2,259,382 | 10/1941 | Ingels | 220/76 |
| 2,720,332 | 10/1958 | Holt | 220/76 |
| 3,108,710 | 10/1963 | Lange et al. | 220/76 |
| 3,355,056 | 11/1967 | Fisch | 220/355 |
| 3,854,269 | 12/1974 | Hancouc | 220/76 |
| 4,014,450 | 3/1977 | Girotti et al. | 220/355 |
| 4,113,098 | 9/1978 | Howard . | |
| 4,273,406 | 6/1981 | Okagami . | |
| 4,491,238 | 1/1985 | Tobolt | 220/355 |

*Primary Examiner*—Joseph Man-Fu Moy

*Attorney, Agent, or Firm*—Marianne R. Rich

[57] ABSTRACT

A liquid-tight seal is achieved in a two-part transformer casing by use of a U-shaped channel in the main body of the casing, the U-shaped channel being formed on one side by a rigid joint member and, on the other side, by a flexible member. Both members are molded in a single unit with the main casing, but the flexible member has a decreased cross-section relative to that of the rigid member. The cover for the casing has a lip extending into the U-shaped channel. The lip is wedge-shaped, having a minimum cross-sectional area at its furthest projection into the U. At its other extremity, the cross-sectional height of the lip slightly exceeds the perpendicular distance between the flexible and rigid members. A rectangular cross-sectional part of the lip immediately adjacent to the cover provides a contact surface for the flexible member, while the rigid member makes contact with the wedge-shaped portion over a greater area. The flexible member thus pushes the lip against the rigid member and, further, provides a backup seal should liquid pass through the seal between the lip and the rigid member.

4 Claims, 2 Drawing Sheets

IMPROVED LIQUID TIGHT TRANSFORMER CASING

This is a continuation of application Ser. No. 097,485, filed Sept. 15, 1987, now abandoned, which is a continuation of Ser. No. 842,055, filed Mar. 18, 1986, now U.S. Pat. No. 4,709,828, issued Dec. 1, 1987, which is a continuation of Ser. No. 746,488 filed June 19, 1985 now abandoned.

FIELD OF THE INVENTION

The present invention relates to two-part transformer casings for high voltage communications transformers and, more particularly, to two-part casings receiving hot liquid potting material in the course of manufacture.

BACKGROUND OF THE INVENTION

The standard two-part transformer casings now in use for high voltage transformers in the communications field consist of a main casing which has a groove or channel of rectangular cross-section into which the cover is slidably inserted. During manufacture, hot liquid potting material, e.g. epoxy, is poured into the case which is then subjected to a vacuum to remove entrapped air. In the past, leakage around the casing-cover seal occurred frequency during this process. To eliminate such leakage; sealers or adhesives were necessary which added to the cost of production.

SUMMARY OF THE INVENTION

It is an object of the present invention to provide a transformer casing in which a liquid-tight mechanical seal is achieved when one part is slid into the other, without use of any additional sealing material.

It is a further object of the present invention to accomplish this end without departing from the material presently in use and without departing from the molding technique now used to manufacture both parts of the casing.

In accordance with the invention, the transformer casing has a first part having a channel adapted to receive a second part slidably inserted therein. The channel has a substantially U-shaped cross-section defined by a first rigid member and a second flexible member extending in a direction substantially parallel to said first member at a predetermined distance therefrom and connected to the first member at a first extremity thereof. The second part has a projecting member substantially wedge-shaped in cross-section and extending into the channel to form the mechanical connection between the first and second part. The wedge has a maximum height in the direction perpendicular to the rigid and flexible member which slightly exceeds the predetermined distance between the latter. The height decreases in a direction extending toward the first extremity of said flexible member so that the contacting surface between the projecting member of said second part and the rigid member of said first part substantially exceeds the contact area between said projecting member of the second part and the flexible member of said first part. As a result of this construction, the flexible member exerts a sealing force onto the projecting member of the second part pressing it against the rigid member, thus creating a tight mechanical seal. In addition, a second or back-up seal is formed at the contact between the flexible member of the first part and the projecting member of the second part of the casing.

In a preferred embodiment, the first part is molded as a single unit, the flexible member being a tapered beam having a substantially decreased cross section at the extremity contacting the projecting member of the second part.

The present invention, as well as additional objects and advantages thereof, will be more fully appreciated from the following detailed description when considered in connection with the accompanying drawing in which:

DESCRIPTION OF THE PREFERRED EMBODIMENT

Figure 3:
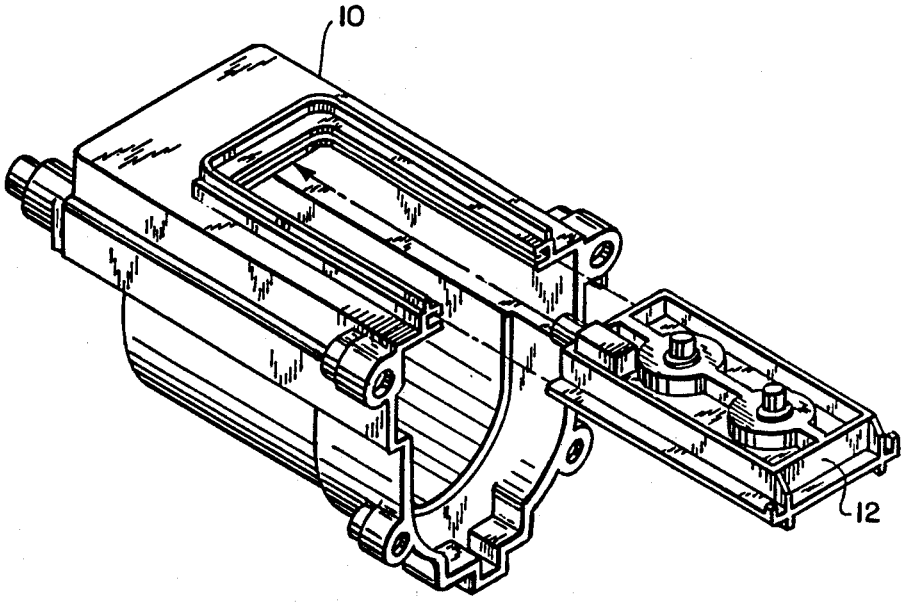
FIG. 3 is an exploded view of a transformer casing and cover to be slidably inserted therein.

The transformer casing shown in an exploded view in FIG. 3 consists of a main casing (or first part) 10 and a cover (or second part) 12. The cover is to slide into the main body in the direction of the arrow. Since the body of the casing contains heated liquid epoxy potting material after the cover is inserted, a liquid-tight seal must be established between the cover and the body of the casing to prevent leakage of the potting material.

Figure 1:
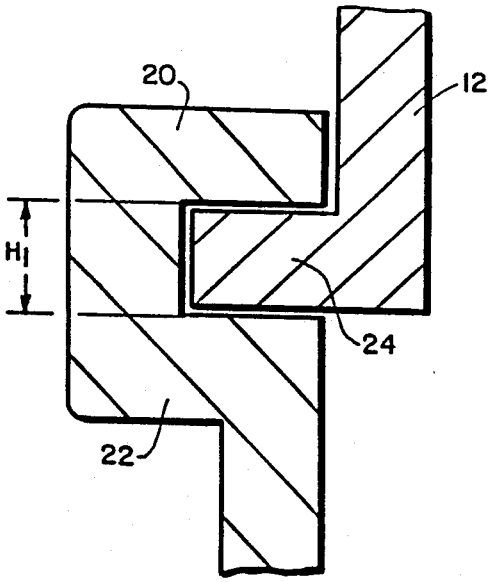
FIG. 1 is a cross-sectional view of a prior art mechanical joint between cover and case.
Figure 2:
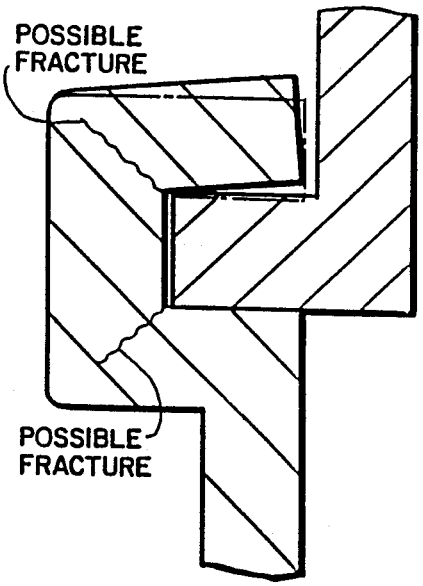
FIG. 2 is a cross-sectional view indicating problem areas for the mechanical joint shown in FIG. 1.

Although transformers casings of the above-described type have been commercially available for approximately 6 years, sealers or adhesives were used during production because of potting compound leakage. The prior art mechanical seal illustrated in FIGS. 1 and 2 illustrate the reason for such leakage. The channel in the main casing is defined by a first and second member, 20, 22 extending in a direction parallel to one another and separated by a distance H forming the height of the channel. Cover 12 has a projection or lip 24 which extends into the channel and whose height is somewhat smaller than the distance H between members 20 and 22. It must be noted particularly that member 20 and 22 have a similar cross-section, both cross-sections being sufficiently large to render the members rigid. With two such rigid members, a clearance must be left between cover and case, i.e. the distance H between the facing surfaces of members 20 and 22 must slightly exceed the height H1 of the cover projection. In the design, the clearance must have a sufficient magnitude to compensate for tolerances in the size of the parts introduced by the molding process. It must further allow for variations in flatness of the mating surfaces of cover and case. These required clearances make a mechanical seal impossible.

A deliberate design interference to allow mechanical sealing would be impossible with this prior art transformer casing, since first, it would require very high force to slide the cover into the case and, secondly, a highly stressed corner would be created (see FIG. 2) which could easily result in breakage.

Figure 4:
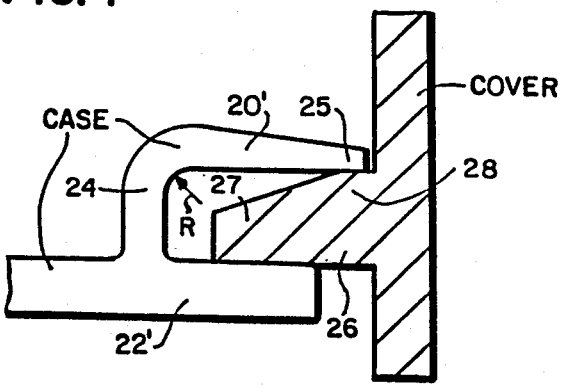
FIG. 4 is a cross-sectional view of the mechanically sealing joint of the present invention.

The above-mentioned problem is avoided by the construction of the present invention as will be explained with reference to FIG. 4. In FIG. 4 the case has a first member 22' which is rigid as it was in the case illustrated in FIGS. 1 and 2. As previously, the second member 20' is connected to member 22' at one extremity 24. However, the cross-sectional area of second member 20′ decreases as the member extends from its first extremity 24 in a direction parallel to the first member to form a U-shaped channel. The decrease in cross-section causes the free end portion 25 of member 20′ to be flexible. Additionally, a lip 26 which projects from the cover and is to be inserted into the U-shaped channel has a first portion 27 with wedge-shaped cross-section and a second portion 28 with a rectangular cross-section. Specifically, the cross-sectional area of wedge-shaped portion 27 decreases as it extends into the channel in the direction towards the bottom of the "U". The wedge shape is such that contact is maintained with rigid member 22′ after contact with flexible member 20′ is made. The flexibility of member 20′ permits design interference between cover and case without creating undue stress in the member. Further, it causes a downward sealing force to be applied to projecting member 26′, so that its bottom surface is tightly pressed against the top surface of member 22′. A liquid-tight seal is thus formed.

If, contrary to expectation, liquid does escape through the seal formed by members 22′ and 26, such liquid would still be sealed into the unit by the back-up seal formed by contact between portion 28 of lip 26 and flexible end portion 25 of member 20′.

The stress at the corners noted in the prior art joint can be further reduced by rounding the junction of the flexible member with the base of the U with a radius R. Similarly, the junction with the rigid member should be somewhat rounded to prevent stress concentration. Finally, the maximum cross-section of the flexible member is maintained at the first extremity to absorb stress safely.

In the preferred embodiment, the legs of the U forming the channel extend in the horizontal direction. The U could also extend in a vertical direction, but gravity or some other force might in that case cause separation between the mating parts unless some external lock were added to the design.

In a preferred embodiment, just as in the prior art, the channel forming members are a molded unit, as is the cover with its projecting member or lip.

A preferred embodiment may be described as follows:

Material: PBT (20% glass) Celanese 3210
Length of rigid member: 0.100 inch
Length of elastic member: 0.100 inch (decreasing cross-section only)
Distance between rigid and flexible member: 0.057/0.060 inch
Maximum height of projecting portion of cover: 0.064 inch
Taper of projecting member: 6°
Length of contact of projecting member and rigid member: 0.068 inch
Length of contact of projecting member and flexible member: 0.040 inch It is seen that by means of the present invention, a liquid-tight mechanical seal can be achieved reliably, without requirement for additional parts or changes in the manufacturing process of a transformer and without use of additional sealing compounds after the unit has been assembled.

While the invention has been illustrated in a preferred embodiment, various modifications and changes in the structure and operation thereof will be evident to one skilled in the art and are intended to be encompassed in the following claims.

I claim:

1. A transformer casing comprising:

a first transformer casing part having at least one side surface and a projecting member extending in a first direction relative to said side surface, said projecting member having a first engagement surface extending in said first direction, and a second engagement surface extending in a direction substantially parallel thereto; and a second transformer casing part having a substantially U-shaped receiving member for receiving said projecting member of said first transformer casing part, said receiving member having an arm and a side, said arm being flexible relative to said side and relative to said projecting member, and said side and said projecting member being rigid relative to said arm, said flexible arm and rigid side having, respectively, a first and a second receiving surface for contacting said first and second engagement surface of said projecting member, respectively, engagement of said projecting member and said U-shaped receiving member causing said relatively flexible arm to deflect, said relatively rigid side remaining relatively underflected, with resilient pressure of said relatively flexible arm on said relatively rigid member creating a first and second liquid tight seal at the so-contacting surfaces.

2. A casing comprising:

a liquid-containing part having a side having a predetermined cross-sectional area which is substantially uniform along said side, and a U-shaped channel having a first leg formed by said side and a second leg, said second leg having a free end portion having a cross-sectional area substantially less than said predetermined cross-sectional area and a second portion attached to said first leg, so that at said free end portion said second leg is flexible relative to said side and said side is rigid relative to said free end portion; and a second casing part having a projecting member adapted to be inserted into said channel, said projecting member having a first surface contacting said relatively rigid side and a second surface contacting said second leg only at said relatively flexible free end portion thereof, the perpendicular distance between said first and second surfaces of said projecting member being at least equal to the perpendicular distance between said first and second leg of said U-shaped channel, whereby a force fit is created between said projecting member, said relatively rigid side, and said relatively flexible free end portion of said second leg.

3. A transformer casing as set for in claim 1, wherein said flexible arm contacts said second surface of said rigid member at a first distance from said surface, and said first surface contacts said rigid side at a second distance exceeding said first distance from said side surface.

4. A casing comprising:

a liquid-containing part having a side having a predetermined cross-sectional area which is substantially uniform along said side, and a U-shaped channel having a first leg formed by said side and a second leg, said second leg having a free end portion having a cross-sectional area substantially less than said predetermined cross-sectional area and a second portion attached to said first leg, so that at said free and portion said second leg is flexible relative to said side and said side is rigid relative to said free end portion; and a second casing part having a projecting member adapted to be inserted into said channel, said projecting member having a first surface contacting said relatively rigid side and a second surface contacting said second leg only at said relatively flexible free end portion thereof, the perpendicular distance between said first and second surfaces of said projecting member being at least equal to the perpendicular distance between said first and second leg of said U-shaped channel, whereby a force fit is created between said projecting member, said relatively rigid side, and said relatively flexible free end portion of said second leg.

* * * * *